US008167696B2

(12) United States Patent
Celona et al.

(10) Patent No.: US 8,167,696 B2
(45) **Date of Patent: *May 1, 2012**

(54) VIDEO POKER GAME AND METHOD

(76) Inventors: Anthony P Celona, Hammonton, NJ (US); Graziano D'Aquilante, Hammonton, NJ (US); Troy DeFrees-Parrott, Las Vegas, NV (US); John P. Meekins, Naples, FL (US)

( * ) Notice: Subject to any disclaimer, the term of this patent is extended or adjusted under 35 U.S.C. 154(b) by 698 days.

This patent is subject to a terminal disclaimer.

(21) Appl. No.: 12/265,019

(22) Filed: Nov. 5, 2008

(65) Prior Publication Data

US 2009/0061976 A1 Mar. 5, 2009

Related U.S. Application Data

(63) Continuation of application No. 10/106,341, filed on Mar. 26, 2002, now Pat. No. 7,448,946.

(60) Provisional application No. 60/278,777, filed on Mar. 26, 2001.

(51) Int. Cl.
*A63F 9/24* (2006.01)

(52) U.S. Cl. ..... 463/13; 463/16; 463/22; 273/292

(58) Field of Classification Search ..... 463/12, 463/13; 273/292

See application file for complete search history.

(56) References Cited

U.S. PATENT DOCUMENTS 5,123,649 A * 6/1992 Tiberio ..... 273/143 R
6,334,613 B1 * 1/2002 Yoseloff ..... 273/292
7,448,946 B2 * 11/2008 Celona et al. ..... 463/13

* cited by examiner

*Primary Examiner* — Omkar Deodhar
(74) *Attorney, Agent, or Firm* — Raymond A. Nuzzo

(57) ABSTRACT

A gaming machine and a method for playing the gaming machine. In one embodiment, the method comprises the steps of providing a gaming machine having a plurality of games and a plurality of corresponding pay-tables wherein each pay-table corresponds to a particular game, making a wager so as to provide a player with an opportunity to play the gaming machine, playing at least two of the games simultaneously if the wager fulfills predetermined criterion, and providing a pay-out to the player in accordance with the pay-tables that correspond to the games being simultaneously played.

1 Claim, 1 Drawing Sheet

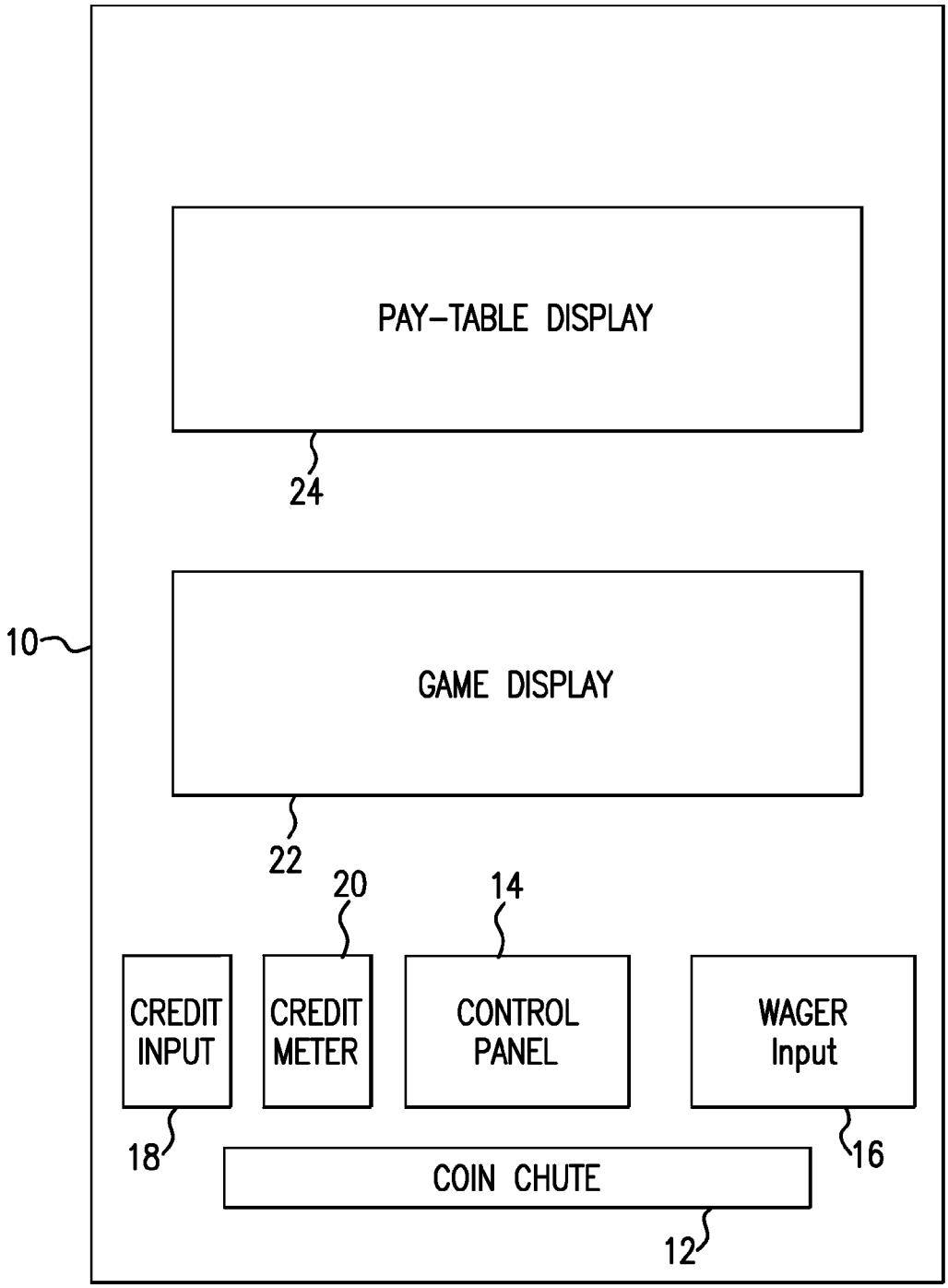
PAY-TABLE DISPLAY
24
10
GAME DISPLAY
22
20
14
CREDIT INPUT
CREDIT METER
CONTROL PANEL
WAGER Input
18
16
COIN CHUTE
12

VIDEO POKER GAME AND METHOD

CROSS-REFERENCE TO RELATED APPLICATIONS

This application is a continuation of U.S. application of No. 10/106,341, filed Mar. 26, 2002 now U.S. Pat. No. 7,448,946, which application claims the benefit of the filing date of U.S. provisional patent application Ser. No. 60/278,777, filed Mar. 26, 2001. The entire disclosures of application Ser. Nos. 10/106,341 and 60/278,777 are hereby incorporated by reference.

FIELD OF THE INVENTION

The present invention generally relates to video poker gaming machines.

DESCRIPTION OF RELATED ART

Conventional video poker games generally offer very limited benefits to players. Therefore, the motivation for players to bet more than five (5) coins per play is relatively low. However, one exception is the standard five (5) card draw poker game called "Triple Play Poker" and is disclosed in U.S. Pat. No. 5,823,873. Casinos provide video poker gaming machines in order to be competitive and to offer players a variety of gaming machines so as to stimulate player loyalty. However, video poker gaming machines yield relatively less revenue per-square-foot in comparison to other gaming machines due to the slow play (players have to make decisions of what cards to hold). Furthermore, video poker machines are the only gaming machines that enable players to have an affect on the maximum pay-back percentage.

The poor revenue showing is exacerbated when the casino attempts to change video poker games to a higher-percentage pay-back in an effort to attract players. For example, if a casino offers a 5/8 poker program which has a base pay-back of approximately 96%, but then decides to convert to a 6/9 poker program, which has a base pay-back of approximately 98%, the 6/9 poker program would have to double the handle of the 5/8 program to yield the same net win. However, it is highly unlikely that the handle will double because most of the existing video poker gaming machines have a five (5) coin-in maximum per-play because there is very little benefit to the player to bet more than 5 coins.

What is needed is a video poker machine that can:

a) increase handle (coins and/or credits in); and b) reward players that play a higher number of coin-in per play, with a higher percentage of pay-back (i.e. the more coins and/or credits played per play, the higher the pay-back percentage).

SUMMARY OF THE INVENTION

The present invention is directed to, in one aspect, a method of playing a wagering game, comprising providing a wagering game and a plurality of different pay-tables, a player placing a wager in order to play the wagering game, providing predetermined wager criteria, determining which of the predetermined wager criteria the wager fulfills, playing the wagering game, and providing a pay-out to the player in accordance with a predetermined number of the plurality of pay-tables wherein the predetermined number depends upon which of the predetermined wager criteria the wager fulfills.

In a related aspect, the present invention is directed to a method of playing a wagering game, comprising providing a wagering game and a plurality of different pay-tables, assigning wager criteria to each pay-table, a player placing a wager in order to play the wagering game, evaluating the wager to determine which of the wager criteria the wager fulfills, playing the wagering game, and providing a pay-out to the player in accordance with a pay-table that has assigned thereto the wager criterion which the wager fulfills.

In a further embodiment, the present invention is directed to a gaming machine, comprising means for providing a wagering game and a plurality of different pay-tables, means for allowing a player to place a wager in order to play the wagering game, means for providing predetermined wager criteria, means for determining which of the predetermined wager criteria the wager fulfills, means for playing the wagering game, means for providing a pay-out to the player in accordance with a predetermined number of the plurality of pay-tables wherein the predetermined number depends upon which of the predetermined wager criteria the wager fulfills.

In yet a further aspect, the present invention is directed to a gaming machine, comprising means for providing a wagering game and a plurality of different pay-tables, means for assigning wager criteria to each pay-table, means for allowing a player placing a wager in order to play the wagering game, means for evaluating the wager to determine which of the wager criteria the wager fulfills, means for playing the wagering game, and means for providing a pay-out to the player in accordance with a pay-table that has assigned thereto the wager criteria that the wager fulfills.

BRIEF DESCRIPTION OF THE DRAWINGS

The foregoing features of the present invention will become more readily apparent and may be understood by referring to the following detailed description of an illustrative embodiment of the present invention, taken in conjunction with the accompanying drawings, in which:

FIG. 1 is a block diagram of a video poker gaming machine in accordance with one embodiment of the present invention.

DESCRIPTION OF THE INVENTION

In one embodiment, the present invention is directed to a video poker gaming machine that incorporates two or more standard five (5) coin poker programs. Each poker program has a particular pay-table associated therewith. A player is dealt one hand of cards and simultaneously plays for the pay-tables of all the standard poker game programs incorporated into the video poker gaming machine. One example of the video poker gaming machine is described in detail in the ensuing description.

There are several embodiments of the present invention. Each one of these embodiments is discussed separately in the ensuing description.

In one embodiment of the invention, the number of poker programs actually activated by the video poker gaming machine of the present invention depends upon the amount of coins-in or credit played. In this particular embodiment, the video poker gaming machine of the present invention is configured to utilizes at three (3) poker programs:

5/7 Double Joker (uses two jokers/95% program)

5/8 Joker (uses one joker/96% program)

6/9 Draw Poker (uses NO jokers/98% program)

In this embodiment, a 54 card deck is used (i.e. 52 card standard playing deck plus two jokers). The jokers can be labeled JOKER I and JOKER II, or DOUBLE JOKER and JOKER. Such a video poker game is played in accordance with the following steps:

a) the player is dealt one hand of cards;

b) the player will play only the 5/7 Double Joker program when the player plays one (1) to five (5) coins and/or credits. Pay-outs are made for specific poker hands on the pay-table corresponding to the 5/7 Double Joker program;

c) the player will play the 5/7 Double Joker program and the 5/8 Joker program when the player plays the $6^{th}$ through $10^{th}$ coins and/or credits. Pay-outs are made for specific poker hands on the pay-tables corresponding to the 5/7 Double Joker program and the 5/8 Joker program. Thus, the player is now simultaneously playing for the pay-tables corresponding to the 5/7 Double Joker program and the 5/8 Joker program for the same five card hand;

d) the player will play the 5/7 Double Joker program, the 5/8 Joker program and the 6/9 Draw Poker program when the player plays the $11^{th}$ through $15^{th}$ coins and/or credits. Pay-outs are made for specific poker hands on the pay-tables corresponding to the 5/7 Double Joker program, the 5/8 Joker program and the 6/9 Draw poker program. Thus, the player is now simultaneously playing for the pay-tables corresponding to the 5/7 Double Joker program, the 5/8 Joker program, and program and the 6/9 Draw poker program for the same five card hand.

If a player has played 15 coins and/or credits and after the draw, ends up with a Royal Flush including 2 Jokers, the player is paid on the 5/7 Double Joker pay-table only (because a Royal Flush with 2 Jokers does not exist as pay-outs on the 5/8 and 6/9 pay-tables).

If the player plays 15 coins and/or credits and after the draw, ends up with a Royal Flush with just one (1) Joker, the player would be paid on both the 5/7 and 5/8 pay-tables. If the player plays 15 coins and/or credits and after the draw, ends up with a natural Royal Flush (no Jokers), the player would be paid on all the pay-tables, the 5/7, 5/8 and 6/9 pay-tables because a natural Royal Flush pay is on all three pay-tables.

In another embodiment of the invention, the player is shifted from one poker game to another depending upon the number of coins-in/credits played. However, pay-outs are based only upon the pay-table that corresponds to the poker program the player is playing at that moment. In this embodiment, video poker gaming machine of the present invention is configured to utilize three poker programs:

5/7 Double Joker (uses two jokers/95% program)

5/8 Joker (uses one joker/96% program)

6/9 Draw Poker (uses NO jokers/98% program)

In this embodiment, a 54 card deck is used (i.e. 52 card standard playing deck plus two jokers). Such a video poker game is played in accordance with the following steps:

a) the player is dealt one hand of cards;

b) the player will play only the 5/7 Double Joker program when the player plays one (1) to five (5) coins and/or credits. Pay-outs are made for specific poker hands on the pay-table corresponding to the 5/7 Double Joker program;

c) the player will play the 5/8 Joker program when the player plays the $6^{th}$ through $10^{th}$ coins and/or credits. Pay-outs are made for specific poker hands on the pay-tables corresponding to the 5/8 Joker program. Thus, the player is now playing only for the pay-table corresponding to the 5/8 Joker program for the same five card hand;

d) the player will play the 6/9 Draw Poker program when the player plays the $11^{th}$ through $15^{th}$ coins and/or credits. Pay-outs are made for specific poker hands based only on the pay-table corresponding to the 6/9 Draw poker program. Thus, the player is now playing only for the pay-table corresponding to the 6/9 Draw poker program for the same five card hand.

It is to be understood that embodiment can be modified so that all poker programs are draw poker programs (i.e. no jokers).

In yet a further embodiment of the present invention, the video poker machine is configured so that a player may select at least two poker programs from a larger group of poker programs and play according to any of the methods and embodiments described in the foregoing description.

In one embodiment, the video poker gaming machine of the present invention is realized by gaming machine 10 shown in FIG. 1. Gaming machine 10 is configured to implement the poker game programs described in the foregoing description. Gaming machine 10 includes electronic data processing circuitry, and data storage components such as random access memory (RAM), read only (ROM), erasable programmable read-only-memory (EPROM) for storing and implementing a plurality of poker programs such as the poker programs described in the foregoing description. Gaming machine 10 generally comprises coin chute 12, control panel 14, wager input 16, credit input 18 and credit meter 20. Coin chute 14 provides winnings or pay-outs in the form of coins in a manner known in the art. Control panel 14 is configured to include push buttons, touch keys or other suitable interfaces for allowing a player to activate gaming machine 10 and playing the games (e.g. poker) provided by gaming machine 10. Wager input 16 enables the player to input wagers in the form of coins or paper currency. Credit input 18 enables players to input or insert a player's card issued by the casino so as to enable the player to play for earned credits in lieu of having to constantly input coins or paper currency into wager input 16. In an alternate embodiment, credit input 18 enables players to use major credit cards to place wagers. Credit meter 20 provides information concerning the amount of credits wagered and won.

Gaming machine 10 further includes game display 22 and pay-table display 24. Game display 22 displays the hand of cards with which the player plays. Pay-table display 24 displays pay-tables that correspond to the poker programs with which gaming machine 10 is programmed. For example, in one embodiment, pay-table display 24 is configured to display pay-tables that correspond to the poker programs described in the foregoing description, e.g. 5/7/Double Joker poker, etc. Pay-table display 24 is configured to display either just one pay-table or a plurality of pay-tables (i.e. two or more).

The following examples illustrates this particular configuration:

EXAMPLE 1

Pay-Table 24 displays only the pay-table for the 5/7 Double Joker Program.

EXAMPLE 2

Pay-Table 24 displays only the pay-table for the 5/8 Joker Program.

EXAMPLE 3

Pay-Table 24 displays only the pay-table for the 6/9 Draw Poker Program.

EXAMPLE 4

Pay-Table 24 displays simultaneously the pay-tables for 5/7 Double Joker and 5/8 Joker Programs.

EXAMPLE 5

Pay-Table 24 displays simultaneously the pay-table for the 5/7 Double Joker, the 5/8 Joker Program, and 6/9 Draw Poker Program.

Game display 22 and pay-table display 24 can be realized by commercially available display technology that is currently being used in electronic gaming machines such as video poker games or video slot machines.

In accordance with the present invention, game display 22 and pay-table 24 are activated when the wagers placed by the player fulfill predetermined wager criteria. The predetermined wager criteria can be the quantity of coins inputted into wager input 16, the cumulative monetary amount of paper currency inputted into wager input 16, or the monetary amount of credits wagered. Other wager criteria are possible.

The following example illustrates one embodiment of the invention.

EXAMPLE 6

In one embodiment of the invention, the number of poker programs actually activated by gaming machine 10 depend upon the quantity of coins inputted into wager input 16. In this particular embodiment, gaming machine 10 is configured to utilize the following three (3) poker programs:

i) 5/7 Double Joker (uses two jokers/95% program);
ii) 5/8 Joker (uses one joker/96% program); and
iii) 6/9 Draw Poker (uses NO jokers/98% program).

In this embodiment, a 54 card deck is used (i.e. 52 card standard playing deck plus two jokers). The jokers can be labeled JOKER I and JOKER II, or DOUBLE JOKER and JOKER. Such a video poker game is played in accordance with the following steps:

a) the player is dealt one hand of cards which are displayed in game display 22;
b) the player will play only the 5/7 Double Joker program when the player wagers one (1) to five (5) coins. Pay-table display 24 displays a pay-table that corresponds to the 5/7 Double Joker program. Pay-outs are made for specific poker hands on the 5/7 Double Joker program pay-table displayed in pay-table display 24;
c) the player then wagers the $6^{th}$ through $10^{th}$ coins;
d) pay-table display 24 now displays pay-tables that correspond to the 5/7 Double Joker program and the 5/8 Joker program. Thus, the player is now simultaneously playing for the pay-tables corresponding to the 5/7 Double Joker program and the 5/8 Joker program for the same five card hand displayed in game display 22. Pay-outs are made for specific poker hands shown on the pay-tables corresponding to the 5/7 Double Joker program and the 5/8 Joker program;
e) the player now plays the $11^{th}$ through $15^{th}$ coins; and
f) pay-table display 24 now displays the pay-tables that, correspond to the 5/7 Double Joker program, the 5/8 Joker program and the 6/9 Draw Poker program. Pay-outs are made for specific poker hands on the pay-tables corresponding to the 5/7 Double Joker program, the 5/8 Joker program, and program and the 6/9 Draw poker program for the same five card hand.

If a player has played 15 coins and after the draw, ends up with a Royal Flush including 2 Jokers, the player is paid on the 5/7 Double Joker pay-table only (because a Royal Flush with 2 Jokers does not exist as pay-outs on the 5/8 and 6/9 pay-tables).

If the player plays 15 coins and after the draw, ends up with a Royal Flush with just one (1) Joker, the player is paid on both the 5/7 and 5/8 pay-tables. If the player plays 15 coins and after the draw, ends up with a natural Royal Flush (no Jokers), the player is paid on all the pay-tables, the 5/7, 5/8 and 6/9 pay-tables because a natural Royal Flush pay is on all three pay-tables.

Gaming machine 10 can be configured to implement other embodiments described in the foregoing description. For example, gaming machine 10 can be configured or programmed to shift the player from one poker game program to another depending upon the quantity of coins inputted into wager input 16 (or amount of credits played). At any given moment, the player is playing only for pay-outs that correspond to a single pay-table displayed in pay-table display 24. As the cumulative quantity of coins wagered increases (or the cumulative amount of credits wagered increases) and fulfills new wager criteria, pay-table display 24 displays new pay-tables, but never more than one pay-table at a time. The following example illustrates this embodiment.

EXAMPLE 7

In this embodiment, gaming machine 10 of the present invention is configured to utilize three-poker programs:

i) 5/7 Double Joker (uses two jokers/95% program);
ii) 5/8 Joker (uses one joker/96% program); and
iii) 6/9 Draw Poker (uses NO jokers/98% program).

In this embodiment, a 54 card deck is used (i.e. 52 card standard playing deck plus two jokers). This game is played in accordance with the following steps:

a) the player is dealt one hand of cards which are displayed in game display 22;
b) the player will play only the 5/7 Double Joker program when the player plays one (1) to five (5) coins and/or credits. Thus, pay-table display 24 will display only the pay-table that corresponds to the 5/7 Double Joker program and pay-outs are made for specific poker hands on the displayed 5/7 Double Joker pay-table;
c) the player will play the 5/8 Joker program when the player plays the $6^{th}$ through $10^{th}$ coins and/or credits. Thus, pay-table display 24 will display only the pay-table that corresponds to the 5/8 Joker program and pay-outs are made for specific poker hands on the displayed 5/8 Joker program pay-table. Thus, the player is now playing only for the pay-table corresponding to the 5/8 Joker program for the same five card hand; and
d) the player plays the 6/9 Draw Poker program when the player plays the $11^{th}$ through $15^{th}$ coins and/or credits. Thus, pay-table display 24 will display only the pay-table that corresponds to the 6/9 Draw Poker program and pay-outs are made for specific poker hands on the displayed 6/9 Draw Poker program pay-table. Thus, the player is now playing only for the pay-table corresponding to the 6/9 Draw poker program for the same five card hand.

It is to be understood that the previous examples in the foregoing description are merely illustrative of possible embodiments, and that other embodiments and configurations are possible.

The principals, preferred embodiments and modes of operation of the present invention have been described in the foregoing specification. The invention which is intended to be protected herein should not, however, be construed as limited to the particular forms disclosed, as these are to be regarded as illustrative or exemplary rather than restrictive. Variations in changes may be made by those skilled in the art without departing from the spirit of the invention. For example, one or more standard 52 playing card decks can be used, with or without wild cards, in any of the embodiments described above. In another example, more than one 5/7 poker program is used, each with a different card format, and each having the same or different pay-back percentages, e.g. 95%, 96%, 98%, etc. In a further example, two 5/8 poker programs are used, each with a different card format. In yet another example, two draw poker games are used, each with a different format.

Thus, any type of poker program can be utilized in the video poker game of the present invention. It is also to be understood that the present invention can be modified to utilize wagering games other than poker-type games. For example, non-poker card games can be used as well.

Accordingly, the foregoing detailed description should be considered exemplary in nature and not limited to the scope and spirit of the invention as set forth in the attached claims.

The invention claimed is:

1. A video poker gaming machine comprising:

means for providing a plurality of different ranges of cumulative wager amounts, each of the different ranges of cumulative wager amounts having a minimum cumulative wager amount and a maximum cumulative wager amount;

means for arranging the plurality of different ranges of cumulative wager amounts in a progressive order wherein the maximum cumulative wager amount in one range of cumulative wager amounts is less than the minimum cumulative wager amount of a next, succeeding range of cumulative wager amounts and wherein any cumulative wager amount in a range of cumulative wager amounts is greater than any cumulative wager amount in a preceding range of cumulative wager amounts;

means for providing at least two different and unique poker pay-tables wherein each poker pay-table is based upon a different and unique poker game that is defined by a distinctive, different rule set and/or playing strategy wherein at least one card has a particular value according to one of the at least two different poker pay-tables and a different value according to at least one other of the at least two different poker pay-tables;

means for assigning each of the at least two different and unique poker pay-tables to a corresponding one of the plurality of different ranges of cumulative wager amounts wherein one of the at least two different poker tables is assigned to a first range of cumulative wager amounts and the other of the at least two different poker pay-tables is assigned to a second, next succeeding range of cumulative wager amounts;

means for dealing only one hand of cards;

means for allowing a player to make a wager;

means for determining the amount of the wager;

means for comparing the amount of the wager made to the cumulative wager amounts in the different ranges of cumulative wager amounts to determine if the wager made is equal to any of the cumulative wager amounts in any of the different ranges of cumulative wager amounts and whether the wager made exceeds the maximum cumulative wager amount of any of the ranges of the cumulative wager amounts; and means for allowing a player to play poker according to the at least two different poker pay-tables simultaneously using the one hand of cards when the wager made is equal to any cumulative wager amount in the next, succeeding range of cumulative wager amounts that is assigned to the other of the at least two different poker pay-tables or when the wager made exceeds the maximum cumulative wager amount of the next, succeeding range of cumulative wager amounts that is assigned to the other of the at least two different poker pay-tables.

* * * * *